US011383549B2

(12) United States Patent
Turner

(10) Patent No.: US 11,383,549 B2
(45) Date of Patent: Jul. 12, 2022

(54) PAINTING TOOL HOLDER

(71) Applicant: Mark Turner, Aberdeen, MD (US)

(72) Inventor: Mark Turner, Aberdeen, MD (US)

( * ) Notice: Subject to any disclaimer, the term of this patent is extended or adjusted under 35 U.S.C. 154(b) by 281 days.

(21) Appl. No.: 16/894,185

(22) Filed: Jun. 5, 2020

(65) Prior Publication Data

US 2021/0237504 A1 Aug. 5, 2021

Related U.S. Application Data

(60) Provisional application No. 62/968,640, filed on Jan. 31, 2020.

(51) Int. Cl.
*B44D 3/12* (2006.01)
*A46B 17/02* (2006.01)

(52) U.S. Cl.
CPC ..... *B44D 3/123* (2013.01); *A46B 17/02* (2013.01)

(58) Field of Classification Search
CPC ..... B44D 3/123; B44D 3/12; B44D 3/121; B44D 3/125; A46B 17/00; A46B 17/02; A47B 81/02; A47B 45/00; A47F 7/0021; A47G 29/08; A47L 13/512; A47L 13/51
USPC ..... 211/65, 66, 70.6, 117, 126.2; 206/736; 248/238, 211, 113, 110, 210, 311.2, 248/309.1, 312, 312.1; D32/54, 53.1, 53
See application file for complete search history.

(56) References Cited

U.S. PATENT DOCUMENTS 1,865,283 A * 6/1932 Sohnle ..... B44D 3/123 220/756
2,454,474 A * 11/1948 Wilbur ..... B44D 3/123 248/113
2,535,260 A * 12/1950 Braswell ..... B44D 3/123 248/113
2,564,043 A * 8/1951 Ward ..... A47J 45/10 248/113
2,625,299 A * 1/1953 Uhlig ..... B44D 3/123 220/736
2,699,882 A * 1/1955 Lieb ..... B44D 3/123 220/699
2,786,707 A * 3/1957 Campbell ..... A47G 21/145 220/759
2,844,256 A * 7/1958 Campbell ..... B44D 3/123 210/473
2,855,123 A * 10/1958 Kintz ..... B44D 3/123 220/756
2,950,012 A * 8/1960 Mascaretti ..... B44D 3/123 211/65
3,182,943 A * 5/1965 Crossman ..... B44D 3/123 248/231.71
3,436,784 A * 4/1969 Roland, Jr. ..... B44D 3/123 15/257.05

(Continued)

*Primary Examiner* — Jennifer E. Novosad
(74) *Attorney, Agent, or Firm* — Boudwin Intellectual Property; Daniel Boudwin

(57) ABSTRACT

A painting tool holder includes a body defining an upper platform and a lower platform, wherein the upper platform and the lower platform are connected via a front support. A rear support extends from the upper platform. The front support and the rear support define a channel therebetween for receiving a rim of a paint can therein. A pair of support rings are disposed on opposing lateral sides of the lower platform. A fastener is disposed on a first side of the upper platform. An upper support ring is disposed on a second side of the upper platform.

8 Claims, 5 Drawing Sheets

(56) References Cited

U.S. PATENT DOCUMENTS 3,531,073 A * 9/1970 Anthony ..... B44D 3/123 248/113
3,642,240 A * 2/1972 Hershey ..... E06C 7/14 248/210
3,688,943 A * 9/1972 Brown ..... B65D 25/20 15/257.05
3,707,242 A * 12/1972 Golden ..... E06C 7/14 220/570
3,729,158 A * 4/1973 Nagy ..... B44D 3/123 248/231.71
3,844,457 A * 10/1974 Smart ..... B44D 3/123 222/570
3,948,413 A * 4/1976 Gorrell ..... B44D 3/123 15/257.05
4,008,808 A * 2/1977 Ramsay ..... A47K 1/09 312/207
4,013,251 A * 3/1977 Cleveland ..... E06C 7/14 248/210
4,036,463 A * 7/1977 Hopkins ..... B44D 3/123 248/210
4,446,972 A * 5/1984 Sussman ..... A47G 29/08 211/60.1
4,475,660 A * 10/1984 Cain ..... A47L 13/51 224/543
4,561,556 A * 12/1985 Bendix ..... B44D 3/123 220/699
4,607,752 A * 8/1986 Sherrow ..... B44D 3/123 248/110
4,657,213 A * 4/1987 Hartlage ..... D06F 81/003 248/117.7
4,722,113 A * 2/1988 Olsson ..... A47L 13/58 15/264
4,751,763 A * 6/1988 Rose ..... A47L 13/58 15/264
4,890,353 A * 1/1990 Shannon ..... B44D 3/123 248/909
4,919,298 A * 4/1990 Gregory ..... B44D 3/14 220/759
4,949,864 A * 8/1990 LaKier ..... B44D 3/123 401/121
4,991,803 A * 2/1991 Buder ..... B44D 3/123 248/113
4,993,767 A * 2/1991 Song ..... A47J 45/10 220/759
5,038,955 A * 8/1991 Studer ..... B44D 3/123 220/736
5,039,052 A * 8/1991 Carafice ..... A47F 5/08 248/533
5,052,581 A * 10/1991 Christ ..... E06C 7/14 220/570
5,083,733 A * 1/1992 Marino ..... B44D 3/123 248/309.4
5,158,023 A * 10/1992 Allen ..... E04G 5/00 182/120
5,217,193 A * 6/1993 Drucker ..... E04D 15/00 248/154
5,375,736 A * 12/1994 Gonzalez ..... B44D 3/123 220/700
5,383,793 A * 1/1995 Hsu ..... H05K 7/1405 361/801
5,396,993 A * 3/1995 Spitler ..... A47J 47/16 248/37.3
5,662,299 A * 9/1997 Mejia ..... B44D 3/123 248/113
5,687,873 A 11/1997 Jones
5,740,883 A * 4/1998 Trank ..... E06C 7/14 248/210
5,816,549 A * 10/1998 Anderson ..... B44D 3/126 248/210
5,881,891 A * 3/1999 Murphy, Jr. ..... A47L 13/51 211/70.6
5,996,952 A * 12/1999 Heywood ..... B44D 3/123 248/213.2
5,996,957 A * 12/1999 Kurtz ..... A47G 23/0225 248/231.21
6,098,749 A * 8/2000 Enochs ..... E04G 5/003 248/238
6,152,311 A * 11/2000 German ..... G06F 1/181 211/175
6,237,802 B1 5/2001 Douglas
6,361,004 B1 * 3/2002 Witherspoon ..... A47J 37/0786 248/231.71
6,419,194 B1 * 7/2002 LoSacco ..... B44D 3/123 248/113
D461,289 S * 8/2002 LoSacco ..... D32/54
6,443,260 B1 * 9/2002 Katz ..... E06C 7/14 248/238
6,446,829 B1 9/2002 Malvasio et al.
6,457,203 B1 * 10/2002 Williams ..... A47L 13/58 15/264
6,494,417 B1 * 12/2002 Gizzi ..... A46B 17/02 248/113
6,505,746 B1 * 1/2003 Johnson ..... A47J 47/16 248/37.3
6,609,685 B1 * 8/2003 Lamont ..... A46B 17/02 248/110
6,837,383 B1 * 1/2005 McElhaney, Jr. ..... B25H 5/00 211/70.6
6,848,540 B2 * 2/2005 Kvam ..... E06C 7/14 248/211
6,929,225 B1 * 8/2005 Kent ..... B44D 3/123 248/312.1
7,077,238 B2 * 7/2006 Butler ..... E06C 7/14 248/210
7,434,699 B2 * 10/2008 Stukenberg ..... A47G 1/1646 211/87.01
7,506,849 B1 * 3/2009 Koster ..... A45D 20/12 34/239
7,559,513 B2 * 7/2009 Kovall ..... B44D 3/123 248/113
7,789,359 B2 * 9/2010 Chopp, Jr. ..... H02G 3/0456 248/210
7,798,336 B2 * 9/2010 Shiao ..... B25H 3/04 211/DIG. 1
8,038,110 B2 * 10/2011 Talbott ..... B65D 25/24 211/184
8,353,490 B2 * 1/2013 Spinelli ..... F16M 11/22 211/175
8,505,788 B2 * 8/2013 Thibault ..... B44D 3/14 224/183
8,517,187 B1 * 8/2013 Westphal ..... A47K 1/09 248/110
9,538,871 B2 * 1/2017 Renkola ..... A47G 19/06
10,717,318 B2 * 7/2020 Baker ..... A46B 17/02
2004/0129851 A1 * 7/2004 George ..... A47F 5/10 248/309.1
2004/0159752 A1 * 8/2004 Vukas ..... A46B 17/02 248/110
2005/0035131 A1 * 2/2005 Martinson ..... B44D 3/123 220/736
2005/0056486 A1 * 3/2005 Butler ..... E06C 7/14 182/129
2005/0145587 A1 * 7/2005 Matthews ..... B25H 3/04 211/70.1
2005/0184077 A1 8/2005 Martinson
2006/0065668 A1 * 3/2006 Whitaker ..... B44D 3/123 220/737
2007/0102436 A1 5/2007 Peccon
2008/0115401 A1 * 5/2008 Roemer ..... A01K 97/10 211/70.6
2008/0185352 A1 * 8/2008 O'Hara ..... A47L 19/02 211/13.1
2009/0184077 A1 * 7/2009 Curet ..... A47C 7/622 211/113
2018/0319207 A1 * 11/2018 Pippus ..... B44D 3/123

(56) References Cited

U.S. PATENT DOCUMENTS

| | | | | |
|---|---|---|---|---|
| 2020/0281441 | A1* | 9/2020 | Kim | A47L 15/505 |
| 2021/0237504 | A1* | 8/2021 | Turner | B44D 3/123 |
| 2021/0298462 | A1* | 9/2021 | Joye | B44D 3/14 |

* cited by examiner

PAINTING TOOL HOLDER

CROSS REFERENCE TO RELATED APPLICATIONS

This application claims the benefit of U.S. Provisional Application No. 62/968,640 filed on Jan. 31, 2020. The above identified patent application is herein incorporated by reference in its entirety to provide continuity of disclosure.

BACKGROUND OF THE INVENTION

The present invention relates to painting tool holders. More particularly, the present invention pertains to a painting tool holder removably securable to a paint can such that a paint brush and a paint roller can be supported thereby.

Many individuals utilize multiple paint brushes and rollers during a given painting task depending on the level of control and area of coverage desired. Paint rollers excel at covering wide flat surfaces quickly with an even coat of paint, whereas typical hand-held paint brushes offer a user finer control, allowing a user to get into smaller areas or to avoid painting undesired surfaces. Often, these various painting took are used interchangeably as the need arises, resulting in a wet paint brush or roller being placed in a storage location while the other painting tool is being used. However, it can be difficult to find safe locations to store painting took covered in wet paint, as the paint can transfer to an undesired surface, causing damage which can be time-consuming or expensive to repair. Alternatively, storing paint brushes with the bristles downward in a container can damage the brush, leading to stray or frayed bristles which can accidentally result in transferring paint outside of the desired area. These damages brushes must then be replaced, which can become quite expensive. Therefore, a device that can readily store a wet paint brush or roller in an upright position near the painter for efficient tool selection is desired.

In light of the devices disclosed in the known art, it is submitted that the present invention substantially diverges in design elements from the known art and consequently it is clear that there is a need in the art for an improvement to existing painting tool holders. In this regard, the instant invention substantially fulfills these needs.

SUMMARY OF THE INVENTION

In view of the foregoing disadvantages inherent in the known types of painting tool holders now present in the known art, the present invention provides a painting tool holder wherein the same can be utilized for providing convenience for the user when storing wet paint brushes and rollers in an upright position on a paint can.

The present system comprises a body having an upper platform and a lower platform, wherein the upper platform and the lower platform are connected via a front support. A rear support extends from the upper platform. In some embodiments, the body comprises an upper portion and a lower portion removably securable to each other, such that the device can be disassembled for storage and to increase efficiency of manufacture. The front support and the rear support define a channel therebetween, such that the channel can receive a rim of a paint can therein, thereby allowing the user to support the body on the paint can. A pair of support rings are disposed on opposing lateral sides of the lower platform. A fastener is disposed on a first side of the upper platform. In some embodiments, the fastener comprises a dip configured to removably secure a stem of a paint roller therein via friction fit, whereas in alternate embodiments, the fastener comprises a magnetic strip configured to magnetically secure the stem of the paint roller thereto. An upper support ring is disposed on a second side of the upper platform. In this way, the user can secure a typical paint brush and paint roller within the painting tool holder disposed on a paint can.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
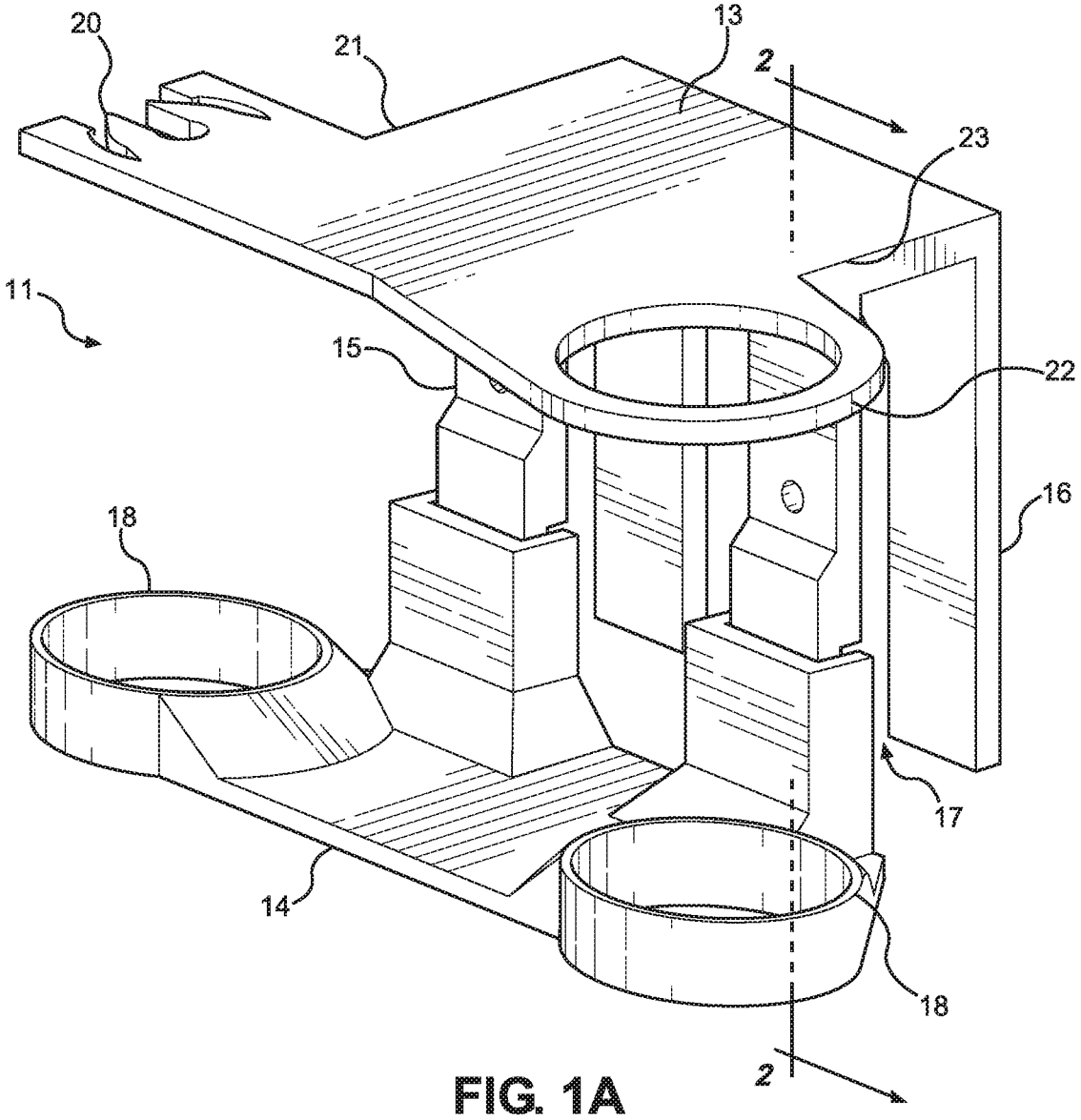
FIG. 1A shows a perspective view of an embodiment of the painting tool holder.

Reference is made herein to the attached drawings. Like reference numerals are used throughout the drawings to depict like or similar elements of the painting tool holder. The figures are intended for representative purposes only and should not be considered to be limiting in any respect.

Figure 1B:
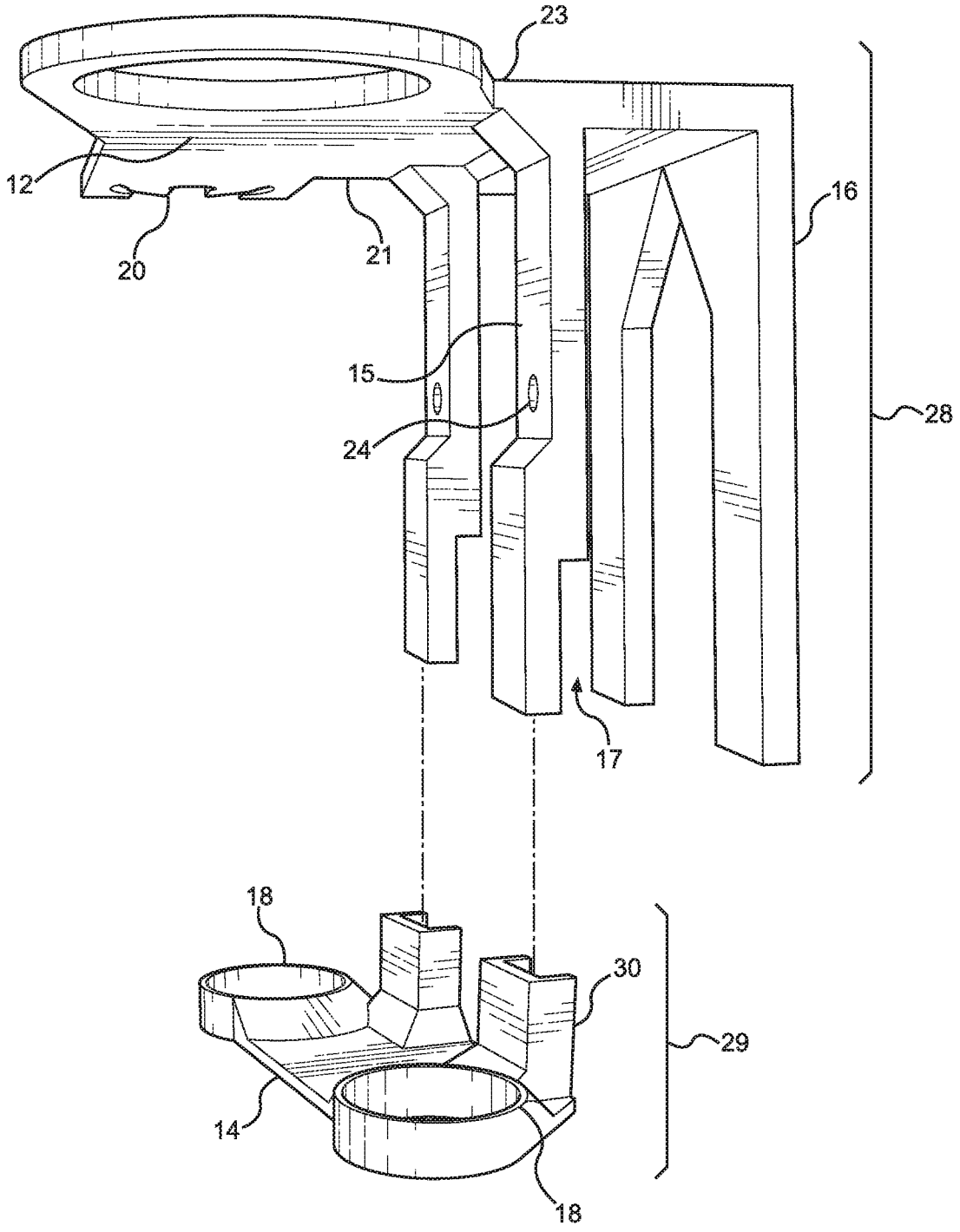
FIG. 1B shows an exploded view of an alternate embodiment of the painting tool holder.
Figure 4:
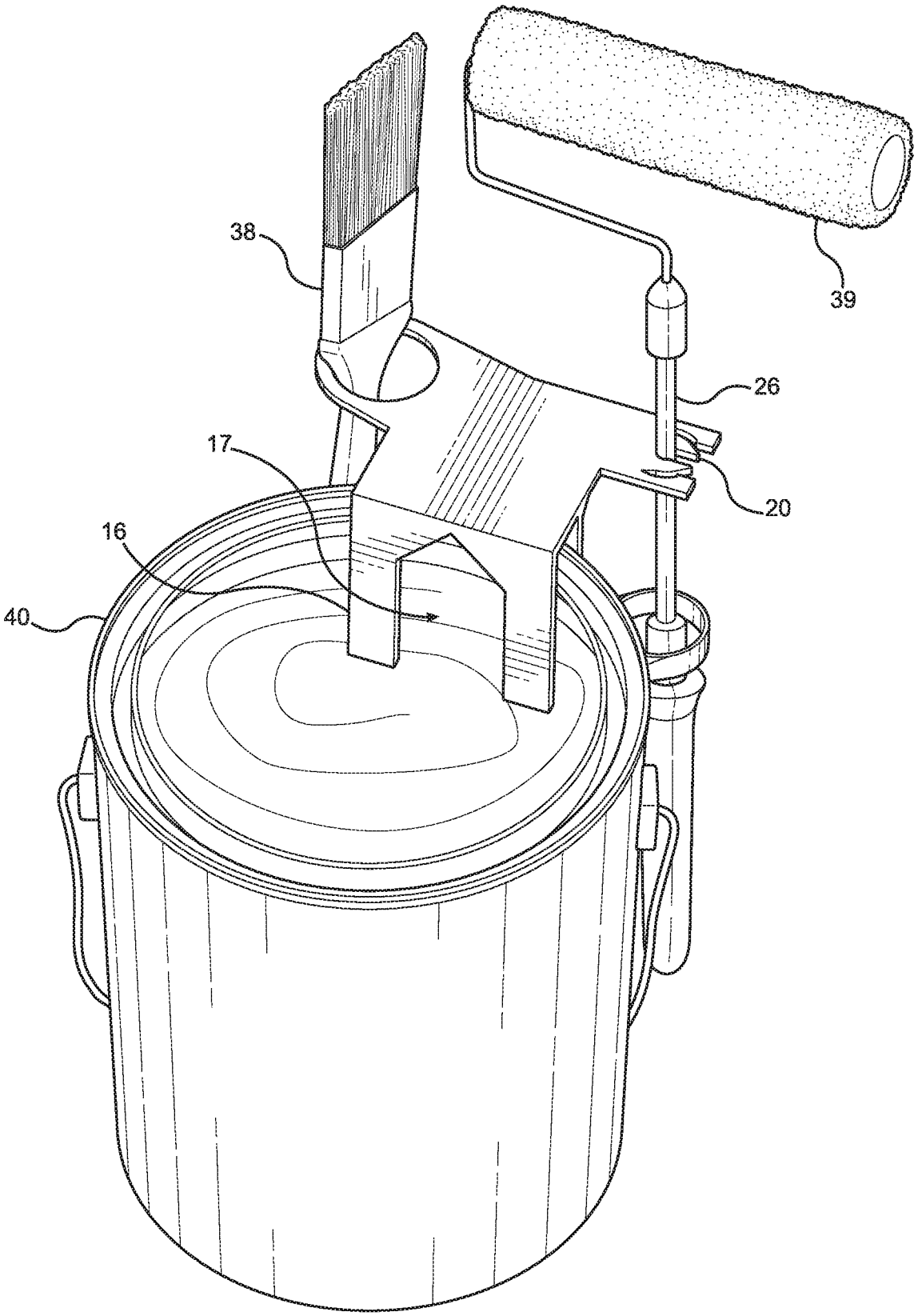
FIG. 4 shows a perspective view of an embodiment of the painting tool holder in use.

Referring now to FIGS. 1A and 1B, there is shown a perspective view of an embodiment of the painting tool holder and an exploded view of an alternate embodiment of the painting tool holder, respectively. The painting tool holder 11 comprises a body having an upper platform 13 and a lower platform 14, wherein the upper platform 13 and the lower platform 14 are connected via a front support 15. In the illustrated embodiment of FIG. 1A, the painting tool holder 11 comprises a unitary structure. In the shown embodiments, a rear support 16 extends from a rear of the upper platform 13 such that a channel 17 is defined between the front support 15 and the rear support 16. The channel 17 is dimensioned to receive a rim of a paint can (as shown in FIG. 4, 40) therein, such that the painting tool holder 11 is supported thereon.

In the illustrated embodiments, each of the front support 15 and the rear support 16 comprise a pair of legs, however, in alternate embodiments, unitary planar front and rear supports 15, 16 are contemplated. In the interest of brevity, the front and rear supports 15, 16 will be shown and described as each comprising a pair of legs throughout the disclosure, however this disclosure is not intended to be limited to embodiments having front and rear supports 15, 16 comprising a pair of legs. In the shown embodiments, the rear support 16 further comprises braces extending between the upper platform 13 and each leg of the rear support 16, such that the braces provide stability to the rear support 16. In the shown embodiment of FIG. 13, an aperture 24 is disposed through the front support 15, wherein the aperture 24 is configured to receive a securement device therethrough, such that the securement device affixes the painting tool holder 11 to the paint can. In some embodiments, the securement device comprises a magnet configured to magnetically secure to the paint can within the channel 17. In alternate embodiments, the securement device can comprise a threaded rod having a knob, such that the threaded rod extends through the aperture 24 into the channel 17 when tightened, thereby securing the painting tool holder 11 to the paint can via frictional engagement.

A pair of support rings 18 are disposed on opposing lateral sides 19 of the lower platform 14. The pair of support rings 18 are configured to receive a handle of a painting tool, such as a paint brush or paint roller, therethrough. In this manner, the pair of support rings 18 limit the mobility of the painting tool when secured within the painting tool holder 11.

An upper support ring 22 is disposed on a second side 23 of the upper platform 13, wherein the upper support ring 22 is configured to secure a head of the painting tool therein such that the painting tool is retained on the upper platform 13. In the shown embodiment, the upper support ring 22 is aligned coaxially with one of the pair of support rings 18 in order to maintain the painting tool stored therein in an upright position. In some embodiments, the upper support ring 22 and the pair of support rings 18 comprise differing diameters. For example, the upper support ring 22 can comprise a smaller diameter than the pair of support rings 18, such that the head of the painting tool is retained upon the upper support ring 22. Various diameters of each of the upper support ring 22 and the pair of support rings 18 are contemplated such that painting tools of various sizes can be accommodated by the painting tool holder 11.

A fastener 20 is disposed on a first side 21 of the upper platform 13, wherein the fastener 20 is configured to removably secure a stem of a paint roller therein. In the illustrated embodiments, the fastener 20 comprises a clip configured to secure the stem of the paint roller therein via frictional engagement, however alternate fasteners 20 are contemplated as described elsewhere herein. The fastener 20 is disposed above one of the pair of support rings 18, such that a handle of the paint roller extends therethrough. In this manner, movement of the paint roller handle is limited, thereby maintaining the paint roller in a substantially upright position when secured to the painting tool holder 11.

In the illustrated embodiment of FIG. 1B, the painting tool holder 11 comprises a body having an upper portion 28 and a lower portion 29 removably securable to each other. The upper platform 13 is disposed on the upper portion 28, and the lower platform 14 is disposed on the lower portion 29. The lower portion 29 comprises a lower support 30 thereon, wherein the lower support 30 is removably securable to the front support 15. In this manner, the painting tool holder 11 can be disassembled for efficient storage and transport while also providing efficiency in manufacture via parallel processes, such as 3D printing.

Figure 2:
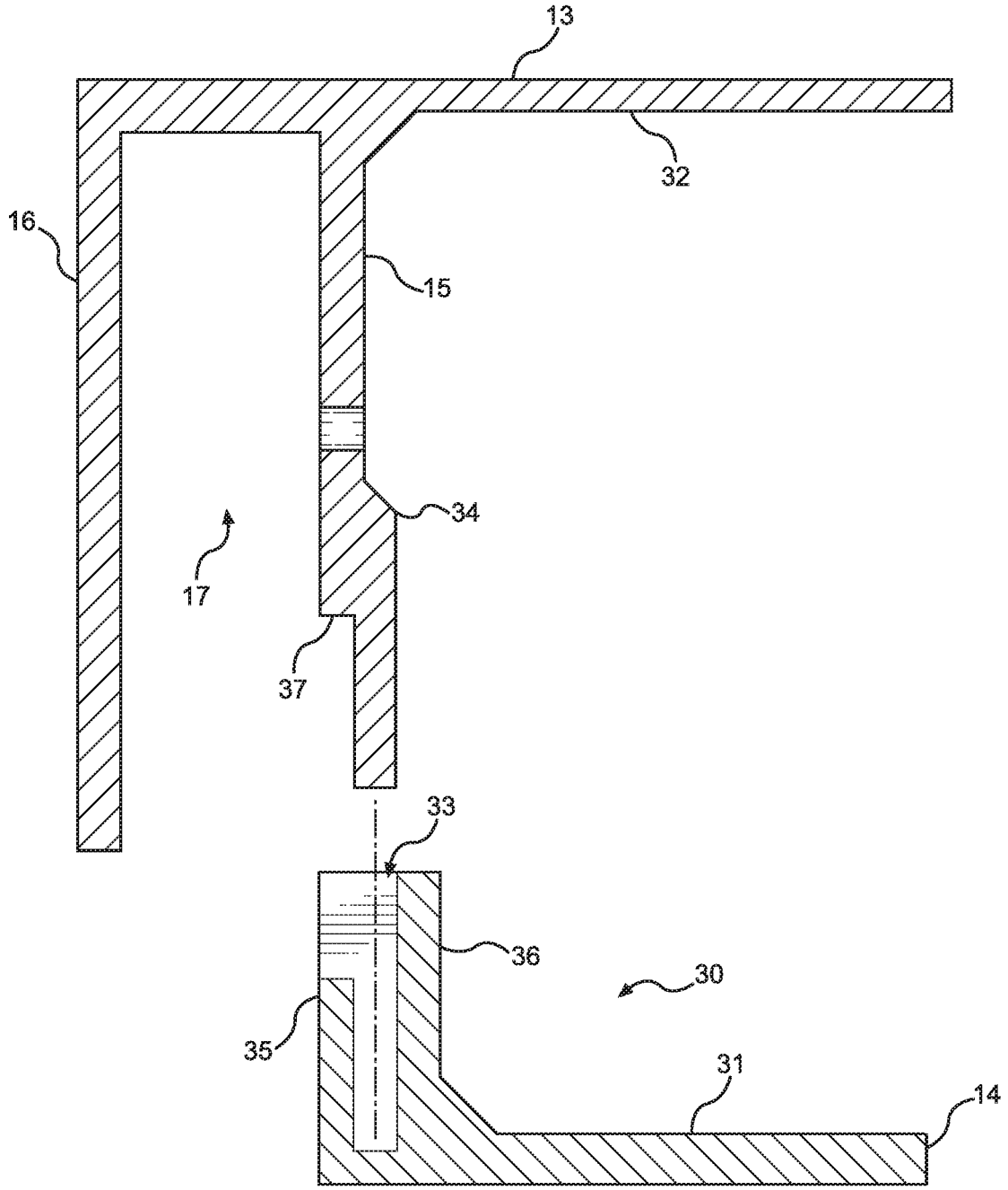
FIG. 2 shows a cross-sectional exploded view of an embodiment of the painting tool holder.

Referring now to FIG. 2, there is shown a cross-sectional exploded view of an embodiment of the painting tool holder. In the illustrated embodiment, the lower support 30 extends from an upper surface 31 of the lower platform 14 and comprises a front wall 36 opposite a rear wall 35 defining a central recess 33 therebetween. The front support 15 extends from a lower surface 32 of the upper platform 13 and comprises a protrusion 34 thereon. The protrusion 34 is configured to removably secure within the central recess 33 via frictional engagement to secure the upper portion to the lower portion. In the shown embodiment, the protrusion 34 is offset from the front support 15, such that a lower edge 37 of the front support rests flush against the rear wall 35 of the lower support 30 when the protrusion 34 is removably secured therein. In this manner, the rear wall 35 is continuous with the front support 15 to provide stability to the painting tool holder. In the shown embodiment, the rear support 16 extends from a rear edge of the upper platform 13 such that the channel 17 is defined between the front and rear supports 15, 16. The spacing between the front and rear supports 15, 16 can vary between embodiments to allow the painting tool holder to be supported on a rim of a paint can at a desired angle. In the illustrated embodiment, the front support 15 is disposed parallel to the rear support 16. Furthermore, the upper platform 13 is disposed parallel to the lower platform 14 to ensure that the painting tools secured therein are maintained in an upright position.

Figure 3A:
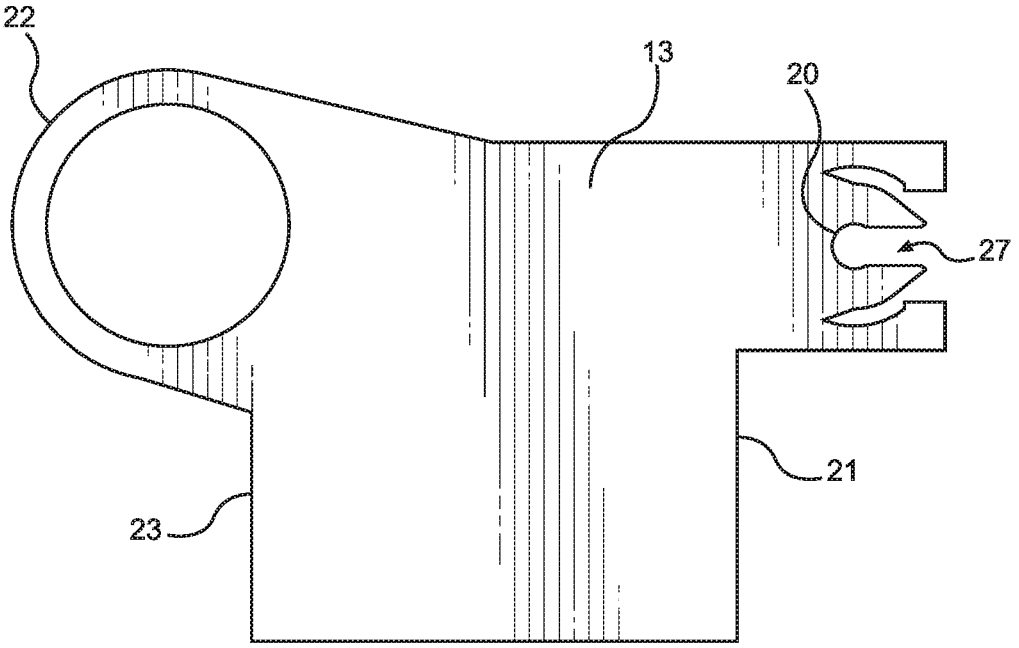
FIG. 3A shows a top down view of the upper platform of an embodiment of the painting tool holder.
Figure 3B:
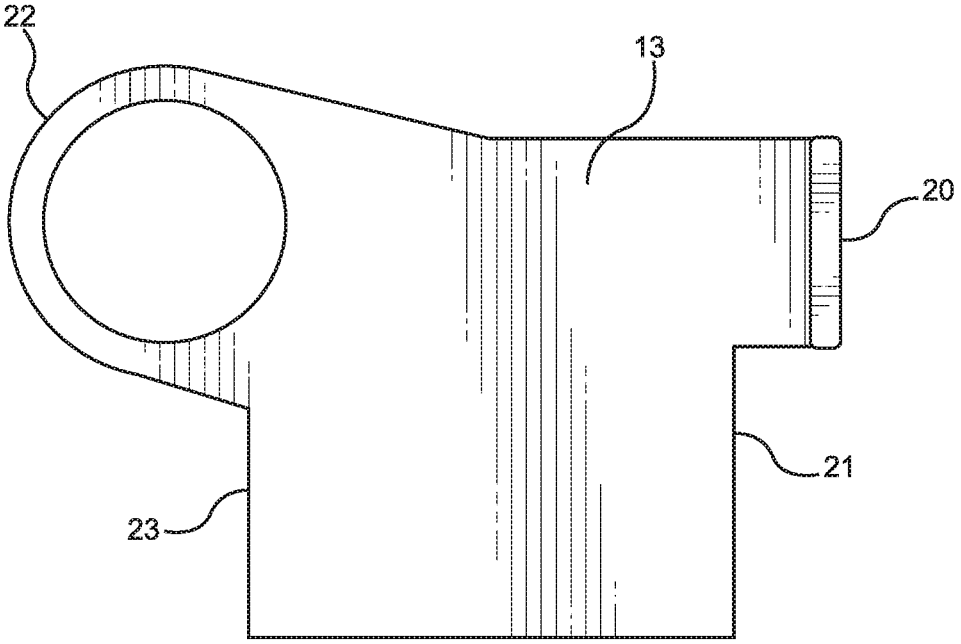
FIG. 3B shows a top down view of the upper platform of an alternate embodiment of the painting tool holder.

Referring now to FIGS. 3A and 3B, there is shown a top down view of the upper platform of an embodiment of the painting tool holder and a top down view of the upper platform of an alternate embodiment of the painting tool holder, respectively. In the illustrated embodiment of FIG. 3A, the upper platform 13 comprises the upper support ring 22 disposed on the second side 23 of thereof, and the fastener 20 on the first side 21 thereof. The fastener 20 is shown as a clip having a plurality of receiving openings 27 therein, wherein each of the plurality of receiving openings 27 is configured to removably secure a stem of a paint roller therein via frictional engagement. In the shown embodiment, the plurality of receiving openings 27 comprise a central opening and a pair of arcuate side openings, such that a user can selectively angle the head of the paint roller from an upright position by securing the stem within one of the pair of side openings, in the shown embodiment, a distal end of the central opening comprises a circular cutout configured to contour to a cylindrical stem of a paint roller. In the shown embodiment of FIG. 3B, the fastener 20 instead comprises a magnetic strip configured to removably secure the stem of the paint roller thereagainst via magnetic force. As the magnetic strip extends along an elongated portion of the first side 21, the user can selectively angle the paint roller as desired to prevent paint drips in an unwanted area.

Referring now to FIG. 4, there is shown a perspective view of an embodiment of the painting tool holder in use. In one use, the painting tool holder is placed on a paint can 40 such that the rim of the paint can 40 is disposed within the channel 17 between the front support and the rear support 16. The rear support 16 serves as an anchor to maintain the painting tool holder on the paint can 40. The user can then secure various painting tools in the painting tool holder as needed for various painting tasks. A typical paint brush 38 can be placed through each of the upper support ring and one of the pair of support rings, such that the head of the paint brush 38 is retained on the upper support ring. A paint roller 39 can also be secured to the painting tool holder by inserting the handle of the paint roller 39 through one of the pair of support rings and engaging the stem 26 of the paint roller 39 within the fastener 20. Additionally, the angle of the paint roller 39 can be adjusted by securing the stem 26 in various positions to prevent undesired paint drips contaminating the surrounding area. In this way, when the user wishes to exchange the current painting tool, the user can secure the previous tool within the painting tool holder to prevent wet paint disposed on the tool from spreading to an unwanted surface.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A painting tool holder, comprising:

a body having an upper portion removably securable to a lower portion;

wherein the upper portion comprises an upper platform and the lower portion comprises a lower platform;

wherein a lower support extends from an upper surface of the lower platform and is removably securable to a front support extending from a lower surface of the upper platform;

wherein the lower support comprises a central recess configured to receive a protrusion extending from the front support therein via frictional engagement;

wherein a rear wall of the lower support comprises a height less than that of a front wall of the lower support, such that the rear wall rests flush against an upper edge of the front support when the protrusion is secured within the central recess;

a rear support extending from the lower surface of the upper platform;

wherein the front support and the rear support define a channel therebetween;

a pair of support rings disposed on opposing lateral sides of the lower platform;

a fastener disposed on a first side of the upper platform;

an upper support ring disposed on a second side of the upper platform.

2. The painting tool holder of claim 1, wherein the front support is disposed parallel to the rear support.

3. The painting tool holder of claim 1, wherein the front support comprises a pair of front legs.

4. The painting tool holder of claim 1, wherein the rear support comprises a pair of rear legs.

5. The painting tool holder of claim 1, wherein the upper support ring is coaxial with one of the pair of support rings.

6. The painting tool holder of claim 1, wherein the fastener comprises a clip configured to receive a paint roller stem therein via frictional engagement.

7. The painting tool holder of claim 6, wherein the clip comprises a plurality of receiving openings therein.

8. The painting tool holder of claim 1, wherein the fastener comprises a magnetic fastener configured to removably secure a paint roller stem thereto.

* * * * *